United States Patent [19]

Parker

[11] Patent Number: 4,593,402

[45] Date of Patent: Jun. 3, 1986

[54] AM STEREO TRANSMITTER

[75] Inventor: Norman W. Parker, Wheaton, Ill.

[73] Assignee: Motorola, Inc., Schaumburg, Ill.

[21] Appl. No.: 653,649

[22] Filed: Sep. 21, 1984

[51] Int. Cl.[4] ..... H04H 5/00

[52] U.S. Cl. ..... 381/16; 455/61

[58] Field of Search ..... 381/2, 15, 16; 332/23 A; 455/61

[56] References Cited

U.S. PATENT DOCUMENTS

| | | | |
|---|---|---|---|
| 4,218,586 | 8/1980 | Parker et al. | 381/16 |
| 4,338,491 | 7/1982 | Parker et al. | 381/16 |
| 4,373,115 | 2/1983 | Kahn | 381/16 |

*Primary Examiner*—Forester W. Isen

*Attorney, Agent, or Firm*—Margaret Marsh Parker; James W. Gillman

[57] ABSTRACT

An AM stereo transmitter with bandwidth limiting utilizes the detection of high frequency energy in the modulating signal to control the difference channel input to the stereo encoder.

4 Claims, 3 Drawing Figures

AM STEREO TRANSMITTER

BACKGROUND OF THE INVENTION

This invention relates to the field of amplitude modulated stereophonic transmission and, more particularly, to the minimization of spectrum spreading.

In the transmission of AM stereo signals, it is theoretically possible, under certain peculiar signal conditions, to produce small amounts of sideband signals which fall outside the desired channel. For this to happen, there must be a large amount of high frequency energy in the stereo or difference channel. With 10 kHz channel spacing, this is an almost impossible condition. With 9 kHz channels, there is a slightly greater chance of the condition occurring.

In another patent, No. 4,338,491, assigned to the assignee of the present invention, one method of reducing the possibility was disclosed. In the simplest form of that invention, the difference channel signal was coupled through a pair of filters, one low pass and one high pass. The output of the high pass filter was compressed before being added to the output of the low pass filter, to be used in a stereo encoder to modulate a carrier. In a second embodiment of the above-referenced invention, a more elaborate system for controlling spectrum spread was provided, but at the cost of much greater complexity in the circuit.

SUMMARY OF THE INVENTION

It is therefore an object of the present invention to provide an improved means for reducing the possibility of adjacent channel interference when high level, high frequency stereo signals are transmitted.

It is a particular object to provide such channel protection with minimal effect on signal fidelity.

It is still another object to provide these advantages with reduced system complexity.

These objects and others which will become apparent are obtained in a transmitter wherein two information signals are transmitted in amplitude modulated stereo and the output of the stereo encoder is bandpass filtered to reduce out-of-channel sidebands before high level modulation. One of the quadrature components of the filter output is detected, filtered in a high pass filter, then coupled to a circuit for detecting high frequency energy. If the high frequency energy content of the high pass filter output is greater than a predetermined value, the amplitude of the difference channel will be reduced accordingly before the modulation or encoding process, thus reducing or eliminating distortion in the envelope of the transmitted signal due to the bandwidth limiting with only a slight reduction in separation in the very high harmonics of the signal.

DETAILED DESCRIPTION OF THE PREFERRED EMBODIMENTS

Figure 1:
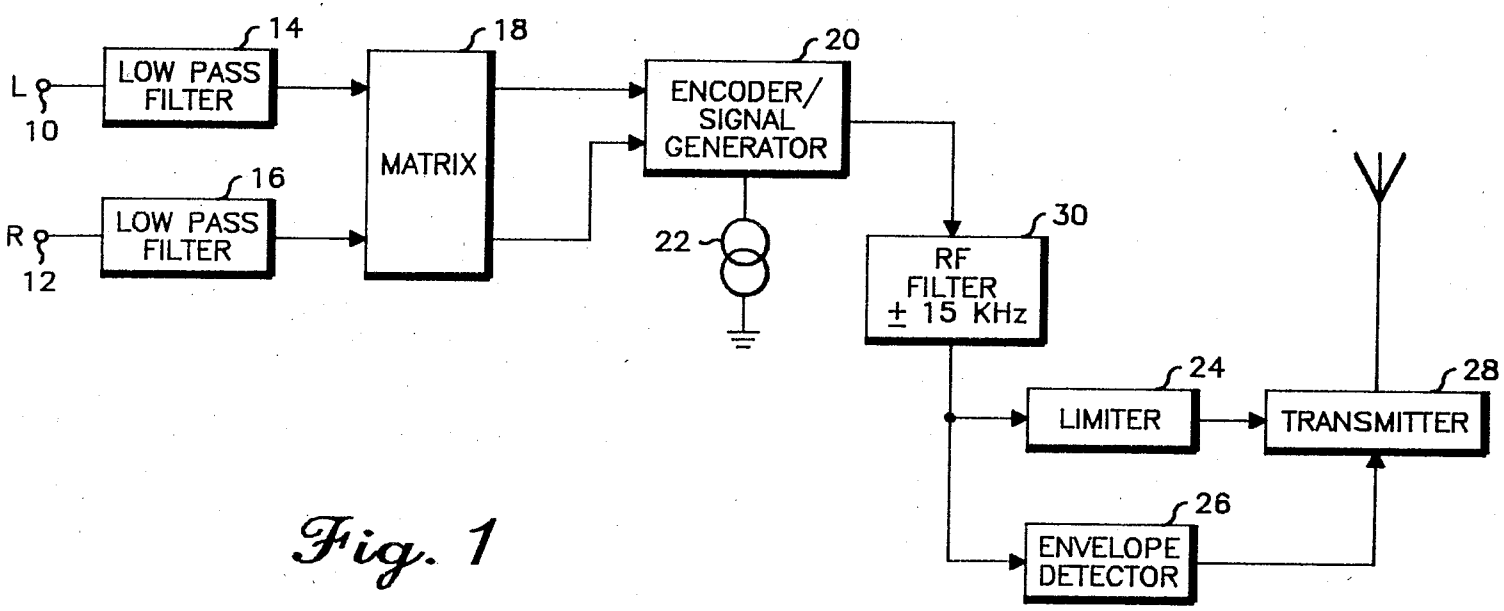
FIG. 1 is a block diagram of a bandwidth-limited AM stereo transmitter without the present invention.

FIG. 1 is a simplified block diagram of an AM stereo transmitter similar to the transmitter used with the C-QUAM stereophonic system disclosed in U.S. Pat. No.

4,218,586, assigned to the assignee of the present invention. In this transmitter there will be two information signal inputs 10,12 which could be R and L signals from two spaced-apart microphones. The two signals received at the terminals 10,12 may be separately filtered in low pass (15 kHz) filters 14, 16. The outputs of the filters 14,16 will be essentially L and R since, in normal speech and music, there are no fundamental tones and only very small amounts, if any, of higher harmonics above 15 kHz. The L and R signals, from the input terminals 10,12 or from the outputs of the filters 14,16, are coupled to a matrix 18 where they are added and subtracted, as is well known, to provide sum (L+R) and difference (L−R) signals. The sum and difference signals are coupled to an encoder/signal generator 20 where they are modulated onto two carrier signals in quadrature, supplied by a single carrier signal generator 22. This type of encoder/signal generator is sometimes termed a "mini-transmitter" since it functions much as a normal transmitter does, but at a very low power level. The output of the encoder/signal generator 20 is then a pure quadrature AM stereo signal; that is, a carrier signal which is amplitude modulated by the square root of the sum of the squares of the sum and difference signal. Since the envelope of this signal is not the same as that of a monophonic signal (1+L+R), it not compatible with monophonic receivers, as is required by law. In order to provide a compatible signal without adding distortion, the modulated signal is limited in a limiter 24 and, at the same time the in-phase modulation is detected in an envelope detector 26. The phase-modulated-only signal from the limiter 24 and the detected envelope signal are coupled to a high level transmitter 28 which then provides an output signal which is phase modulated in accordance with the phase of the pure quadrature signal from the encoder 20 and amplitude modulated with the sum signal. It is not usually practical to amplitude modulate a carrier signal before the carrier frequency is amplified to the high level required for transmitting.

In the corresponding stereophonic receiver, the demodulated signals are easily corrected by a function of the angle of modulation.

As described above, the transmitter of FIG. 1 would be a standard AM stereo transmitter as known; however, it can be seen that the output of the encoder/signal generator 20 has been coupled through an RF bandpass filter 30 with a passband 30 Khz wide (±15 Khz) centered on the carrier frequency. The filter 30 therefore removes all sidebands over 15 kHz from the carrier frequency. This process alone will remove any remote possibility of adjacent channel interference, but, unfortunately, it can also put distortion into the envelope of the transmitted signal.

Figure 2:
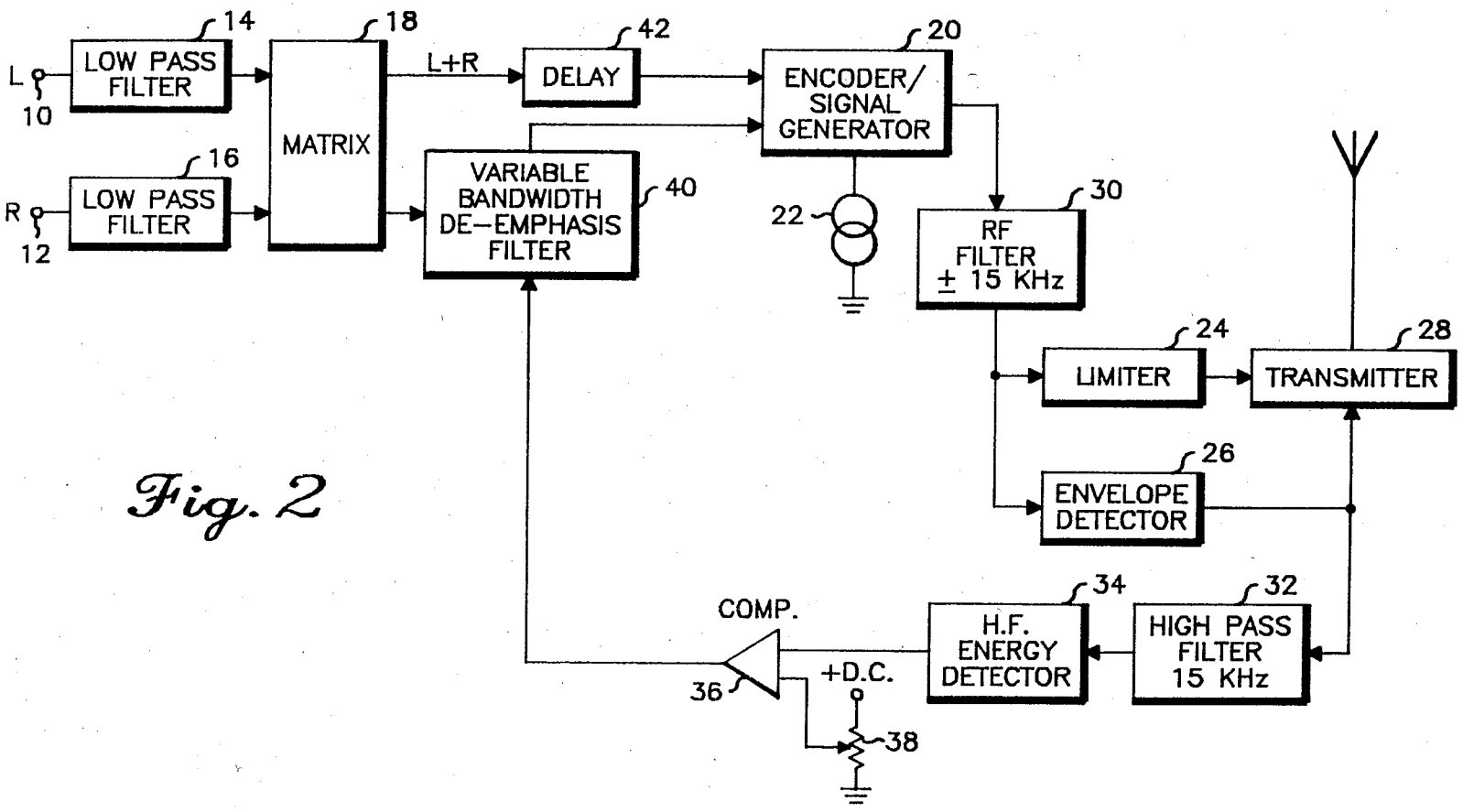
FIG. 2 is a block diagram as in FIG. 1, but including an embodiment of the present invention.

In FIG. 2 is seen a means for removing any such distortion in the envelope. The elements of the transmitter in FIG. 1 operate very much the same in this transmitter. However, it will be seen that the output signal of the envelope detector 26, which modulates the high level transmitter 28, now is also coupled through a high pass filter 32. The filter 32 cuts off all signals below approximately 15 kHz. Any output from the filter 32, therefore, represents distortion in the envelope detector 26 output in the form of unwanted higher harmonics.

The output of the filter 32 is coupled to a high frequency energy detector 34. The detector 34 is basically an envelope detector, but has been labelled as above to emphasize that the input to the detector is not the actual envelope of the output signal of the encoder 20, or the output of the envelope detector 26. The output of the high frequency energy detector 34 is a measure of the unwanted harmonics in the envelope detector 26 output. The detector 34 output is coupled to a comparator 36, wherein it is compared with a predetermined reference voltage supplied by a reference source 38. If the detector 34 output exceeds the level of the reference, a variable bandwidth de-emphasis filter 40 will be controlled accordingly.

The signal input to the variable bandwidth filter 40 is the difference channel output of the matrix 18 or (L−R); the output of the filter 40 is coupled to the encoder/signal generator 20. The variable bandwidth filter 40 could be one of many on the market which provide no filtering up to a given frequency, then provide increasing attenuation with frequency above the given frequency. The amount of attenuation will depend on the enabling signal from the comparator 36. Under all normal operating conditions; i.e., with typical program inputs of speech or music, the function of the variable bandwidth filter 40 will not be enabled and its input and output will be unchanged with respect to frequency. With an unusually strong high frequency difference channel signal, it is possible for there to be sufficient high frequency energy in the output of the envelope detector 26 to enable the filter 40. It is also possible that, in countries where the AM channel bandwidth is limited by law to 9 kHz, the setting of the reference source 38 might be adjusted for a lower reference value. A delay 42 may be a desirable addition in the L+R channel in order to compensate for any delay introduced into the difference channel (L−R) by the variable bandwidth de-emphasis filter 40.

Figure 3:
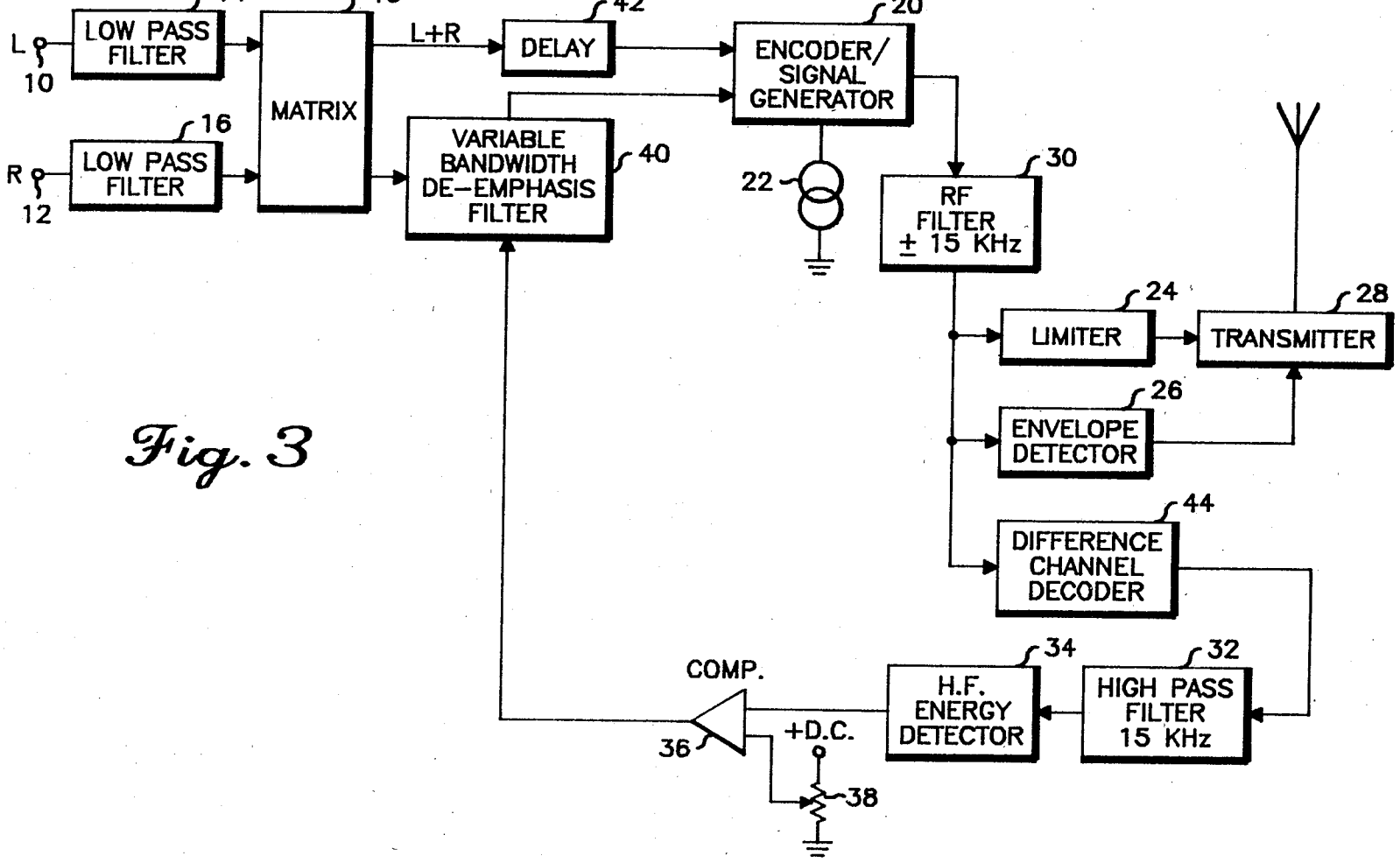
FIG. 3 is a block diagram similar to FIG. 2, including another embodiment of the invention.

The transmitter of FIG. 3 is very similar to that of FIG. 2, with the exception that, instead of coupling the output of the envelope detector 26 to the high pass filter 32, a difference channel decoder 44 would be added, also coupled to the output of the RF filter 30. The output of the difference channel decoder 44 would then be coupled to the high pass filter 32. The filter 32, the high frequency energy decoder 34, the comparator 36 and variable bandwidth filter 40 would then function as in the transmitter of FIG. 2. It is also possible that a transmitter might use a combination of functions; i.e., a difference channel detector 44 might be included, with a simple switching circuit (not shown) to allow a choice of inputs, envelope or difference signals, to the high pass filter 32.

Thus, there has been shown and described an AM stereo trasmitter which can eliminate any possibility of adjacent channel interference, while maintaining the compatibility required for a satisfactory AM stereo transmission. This will be achieved with only slight, if any, loss of separation since only the higher harmonics of the program signals will ever be affected. Other variations and modifications are possible, and it is intended to cover all such as fall within the spirit and scope of the appended claims.

What is claimed is:

1. A transmitter for transmitting a compatible AM stereophonic signal and comprising:

input means for providing two information signals;

matrixing means coupled to the input means for providing sum and difference output signals from the two information signals;

carrier signal generator means for providing a carrier frequency signal;

encoder means coupled to receive the matrixing means output signals and the carrier frequency signal and for amplitude modulating the carrier signal in quadrature with the sum and difference signals;

first bandpass filter means coupled to the output of the encoder means for removing out-of-channel sidebands from the encoded carrier signal;

first detector means coupled to the first filter means for detecting the amplitude of at least one component of the encoded and filtered signal;

second high pass filter means coupled to filter the output signals of the first detector means;

second detector means coupled to detect the level of energy in the second filter means output signal;

third filter means coupled to control the level of the difference signal coupled to the encoder means in response to the second detector means output signals.

2. A transmitter in accordance with claim 1 and wherein the first bandpass filter means has a pass band of about ±15 kHz centered on said carrier frequency signal.

3. A transmitter in accordance with claim 1 and wherein the second high pass filter means passes those frequencies above about 15 kHz.

4. A transmitter in accordance with claim 1 and wherein the third filter means is a variable bandwidth de-emphasis filter.

* * * * *